United States Patent [19]

Altenpohl et al.

[11] 4,221,106

[45] Sep. 9, 1980

[54] TIGHT BAGGING SYSTEM FOR POULTRY

[75] Inventors: William F. Altenpohl; Paul J. Altenpohl, both of High Point, N.C.

[73] Assignee: W. F. Altenpohl, Inc., High Point, N.C.

[21] Appl. No.: 956,994

[22] Filed: Oct. 31, 1978

Related U.S. Application Data

[63] Continuation-in-part of Ser. No. 845,231, Oct. 25, 1977.

[51] Int. Cl.[3] ..... B65B 63/02; B65B 43/36

[52] U.S. Cl. ..... 53/530; 53/572; 53/258; 53/261; 53/385

[58] Field of Search ..... 53/74, 572, 530, 258, 53/260, 261, 385

[56] References Cited

U.S. PATENT DOCUMENTS

| | | | |
|---|---|---|---|
| 2,899,788 | 8/1959 | Beebe | 53/262 |
| 3,206,913 | 9/1965 | Fleigher et al. | 53/572 |
| 3,715,857 | 2/1973 | Fronczak | 53/572 X |
| 3,988,874 | 11/1976 | Altenpohl et al. | 53/502 X |
| 4,023,329 | 5/1977 | Kupcikeuicius et al. | 53/259 |
| 4,141,194 | 2/1979 | Rochman | 53/572 X |
| 4,157,003 | 6/1979 | Kamphaus | 53/258 X |

*Primary Examiner*—Travis S. McGehee

*Attorney, Agent, or Firm*—Clarence A. O'Brien; Harvey B. Jacobson

[57] ABSTRACT

Double leg suspended poultry dropped from a moving conveyor and guided into bags by a nozzle assembly that effects limited expansion of each bag in advance of entry of each bird into the bag. A ram packs each bird fully into the bag after partial entry resulting in tight fit packaging upon withdrawal of the ram and nozzle assembly from the bag as it is detached and dropped onto a receiving surface.

8 Claims, 8 Drawing Figures

TIGHT BAGGING SYSTEM FOR POULTRY

This invention relates to the packaging of poultry in flexible film bags and is an improvement over the invention disclosed in our prior copending application Ser. No. 845,231, filed Oct. 25, 1977, with respect to which the present application is a continuation-in-part.

BACKGROUND OF THE INVENTION

According to our prior copending application, a method of packaging poultry in tight-fitting bags in an automatic fashion, is disclosed. Although automatic packaging of regular machine-made products within individual packaging containers is well known, because of the irregularities in contour and weight distribution associated with poultry, no automatic tight-fit packaging of poultry suspended from a moving conveyor was deemed to be feasible prior to the invention disclosed in the aforementioned copending application, because of tumbling and dimensional interference. It was discovered, however, that automatic packaging could be effected as a practical matter if the birds were suspended in the same orientation from both legs by double hook carriers and dropped from the moving conveyor onto a fixed inclined surface for guided descent into the flexible film bag inflated by a stream of air from a blower associated with the bagging machine having a bag holding rack from which the bags are detached and dropped upon receipt of the product therein.

The packaging achieved by the invention disclosed in the aforementioned prior copending application, was limited in degree of tight-fit for any bag size and matching product weight range because of variations in product size, contour and weight distribution. It is, therefore, an important object of the present invention to increase the degree of tight-fit between the product and the packaging container as well as to improve operational reliability for automatic packaging of poultry dropped from a moving conveyor.

SUMMARY OF THE INVENTION

In accordance with the present invention, poultry automatically dropped from a moving conveyor onto an inclined surface of a bagging machine for guided descent into the top inflated bag, partially enters the inflated bag through a nozzle assembly projected into the open end of the bag in advance of poultry entry. The nozzle assembly includes a convergent entry passage to laterally compress the bird as it enters the bag. Further, as the nozzle assembly is projected into the bag, it laterally expands somewhat to cause dimensional enlargement of the open portion of the bag transversely of the direction of entry. The bird is pushed through the expanded passage of the nozzle assembly by a ram advanced in sequence to fully pack the bird into the bag after partial entry under gravitational inducement. Withdrawal of the ram and nozzle assembly permit contraction of the bag material about the bird. The nozzle assembly is of course contracted from its expanded condition as it is being retracted. Further, the bag is detached from its rack as the bird is fully packed into it by the ram, and drops onto a receiving surface.

In accordance with another feature of the invention, the outflow of air from the blower inflating the top bag on the bag holding rack, is temporarily cut off as the ram executes its packing operation. The air cut-off operation is timely effected during an automatic operational cycle initiated by release of a bird from its two point suspension on a carrier at the packaging station to which it is conveyed by an overhead conveyor. In one embodiment of the invention, a pressurized air control circuit interfaced with the nozzle, ram and air cut-off valve through fluid operated piston devices, controls the operational cycle.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
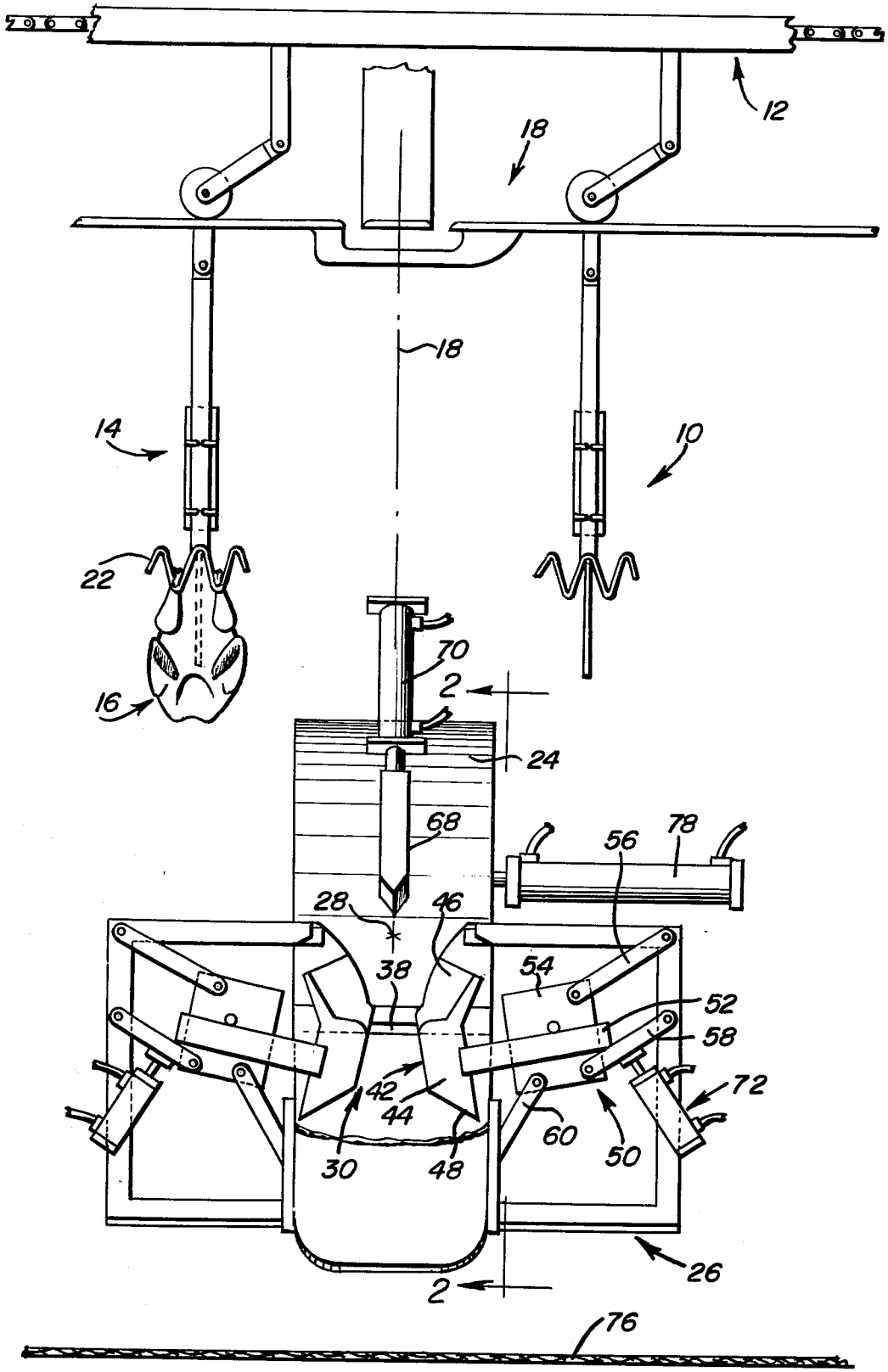
FIG. 1 is a front elevational view showing the typical installation for the present invention.
Figure 2:
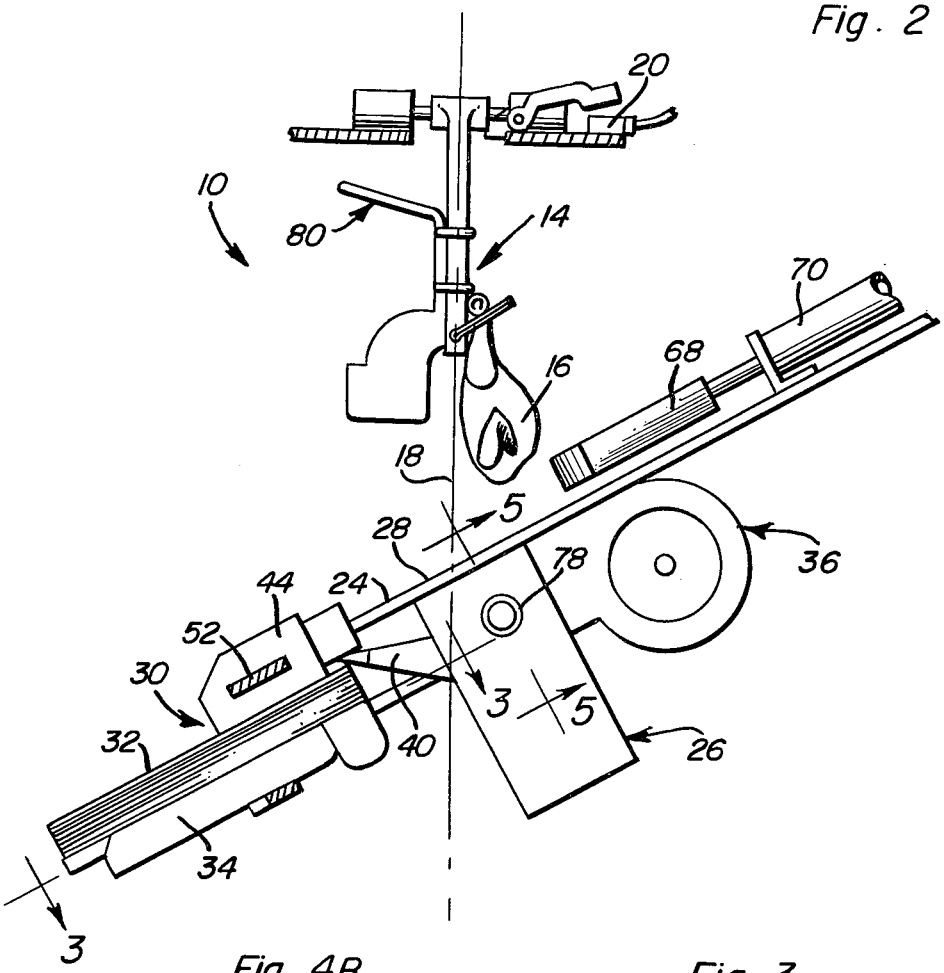
FIG. 2 is a partial side section view taken substantially through a plane indicated by section line 2—2 on FIG. 1.

Referring now to the drawings and detail, FIGS. 1 and 2 illustrate a packaging installation generally referred to by reference numeral 10 suitably located below an overhead conveyor 12 in a poultry processing plant. By means of the overhead conveyor 12, poultry carriers generally referred to by reference numeral 14 convey birds 16 to a weighing station 18 of a well known type at which birds within a pre-selected weight range are automatically dropped for free fall along a path indicated by reference numeral 18. In a manner well known in the art, dropping of a bird at the weighing station 18 is detected by a sensor 20 from which a bird release signal originates. This signal initiates an automatic packaging cycle as will be explained in detail hereinafter.

As disclosed and claimed in our prior copending application aforementioned, the birds conveyed to the weighing station are suspended by both legs by means of double hooks 22 associated with the poultry carrier 14. When released, each bird undergoes a short free fall before impact with a fixed, inclined guide surface 24 supported by a suitable frame assembly generally referred to by reference 26. Impact occurs at a location 28 on the guide surface 24 adjacent its lower end portion forming part of a bag packaging machine generally referred to by reference numeral 30. The bag packaging machine also includes a pack of film bags 32 supported on a bag supply rack 34 fixedly mounted in parallel space relationship to the guide surface 24. Also associated with such bagging machine is an air blower 36 by means of which the top bag on the bag supply rack 34 is inflated through its upper open end 38. Accordingly, an air discharge nozzle 40 underlying the lower end portion of the guide surface 24, directs a stream of air into the open end of the topmost bag 32 in order to cause it to be inflated or opened in preparation for entry of a bird.

In accordance with the present invention, an adjustable nozzle assembly generally referred to by reference numeral 42 is associated with the bagging machine in order to establish an entry passage into the topmost bag in advance of a bird undergoing guided descent into the bag. The nozzle assembly 42 includes a pair of movable guide members 44 that are laterally spaced from each other and have convergent and divergent sections 46 and 48 to define a variable cross-sectional area of the entry passage. An actuating linkage assembly generally referred to by reference numeral 50 is mounted by the frame assembly 26 and is connected to each of the guide members 44 in order to effect downward projection of the nozzle assembly into the top opened bag as well as lateral expansion of the nozzle assembly as it is advanced into the bag.

Figure 3:
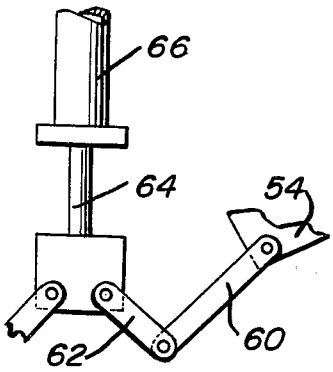
FIG. 3 is a partial section view taken substantially through a plane indicated by section line 3—3 in FIG. 2.

As more clearly seen in FIGS. 1 and 3, the actuating linkage assembly 50 includes an arm 52 extending laterally from each nozzle member 44, each arm being rigidly connected to a linkage connector 54. The connector 54 is interconnected with the frame by means of a pair of parallel links 56 and 58 so as to constrain its movements in a desired path in response to an actuating force applied thereto through a connecting link 60. Connecting link 60 is connected by means of a link 62 to the end of a piston rod 64 extending from a fluid operated piston actuator 66 as more clearly seen in FIG. 3.

Figure 4B:
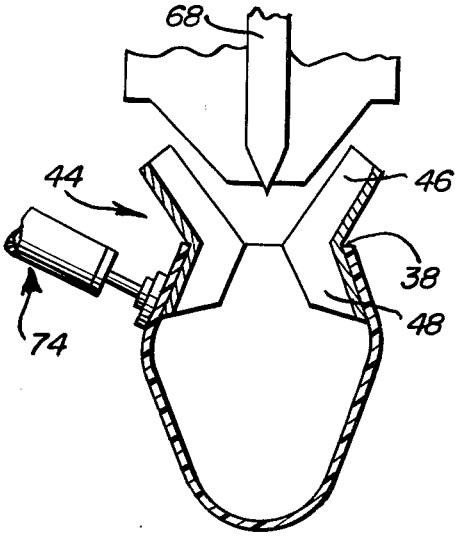
FIGS. 4A and 4B are partial section views showing an open film bag during two operational phases associated with the present invention.
Figure 4A:
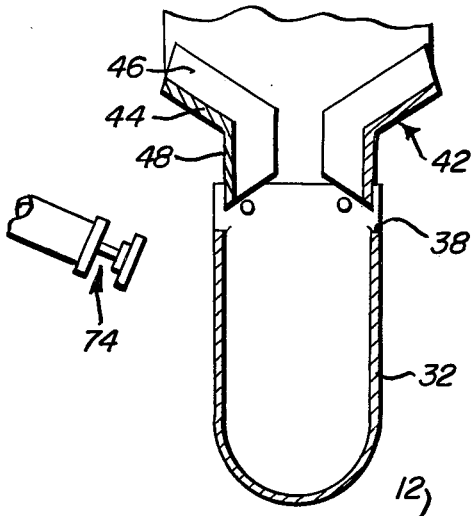

As shown in FIG. 4A, the nozzle assembly 42 in the retracted position is closely spaced above the bag opening 38. The entry passage formed by the nozzle members 44 is rather wide along the convergent section 46 and rather narrow along the divergent section 48 so that a descending bird may be guided into the entry passage before entering the bag. FIG. 4B shows the nozzle assembly projected into the opened bag with the divergent section 48 of the entry passage laterally expanded causing a cross-sectional enlargement of the opened bag and stretching of its film material to some extent. Accordingly, entry of the bird into the bag is facilitated. Once the bird is completely enclosed within the bag, the nozzle assembly 44 is contracted laterally as it is being withdrawn so that the expanded bag may contract onto the bird and produce a tight-fit package.

As shown in FIGS. 1 and 2, a bird packing ram 68 is positioned above the inclined guide surface 24 and connected to the projecting piston rod of a ram actuator 70. The ram is advanced downwardly parallel to the guide surface 24 by the piston actuator 70 after the bird partially enters the open bag expanded by the nozzle assembly 42 in order to fully pack the bird into the bag. FIG. 4B shows the packing ram 68 in its extended position for this purpose. The ram is retracted simultaneously with the nozzle assembly 42 after the bird is fully packed into the bag.

When the bird is fully packed into the bag by the ram, the bag becomes detached from the supply rack of the bagging machine in response to the gravitational load of the bird and the force applied thereto by the ram. Detachment is occasioned by rupture of the flap of the bag at which the bag is held on the rack as described in our prior copending application aforementioned. In order to regulate projection of the nozzle assembly into the bag, a fluid retarding device 72 engages one of the linkages 58 of the nozzle actuating linkage assembly 50 as shown in FIG. 1. The fluid retarder will therefore prevent abrupt engagement of the film material by the nozzle assembly to prevent rupture. Further, while the bag is engaged by the nozzle assembly during entry of the bird into the bag, it is held clamped to the nozzle assembly by a piston operated clamping device 74 as shown in FIG. 4B. The clamping device 74 is of course retracted out of engagement with the bag as shown in FIG. 4A at the same time that the nozzle assembly and ram are retracted in order to permit detachment of the packed bag from its supply rack. The clamping device 74 will prevent premature detachment of the bag. Once the packed bag is detached, it will drop onto a receiving surface 76 as shown in FIG. 1 which may be the upper run of a delivery conveyor.

Figure 5:
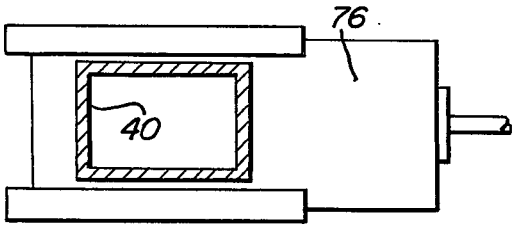
FIG. 5 is a partial section view taken substantially through a plane indicated by section line 5—5 in FIG. 2.

In the usual bagging machine, a continuous stream of air is emitted by the blower 36 to hold the top bag open. In accordance with the present invention, however, this air stream is cut off temporarily after the bird has entered the bag. Toward that end, a slidably displaceable valve plate 76 is operatively mounted for movement across the flow area of the discharge nozzle 40 of the blower as more clearly seen in FIG. 5. The air cut off valve plate 76 is connected to an air cut-off valve actuator 78 of the piston type extending laterally from the frame as more clearly seen in FIG. 1.

Figure 6:
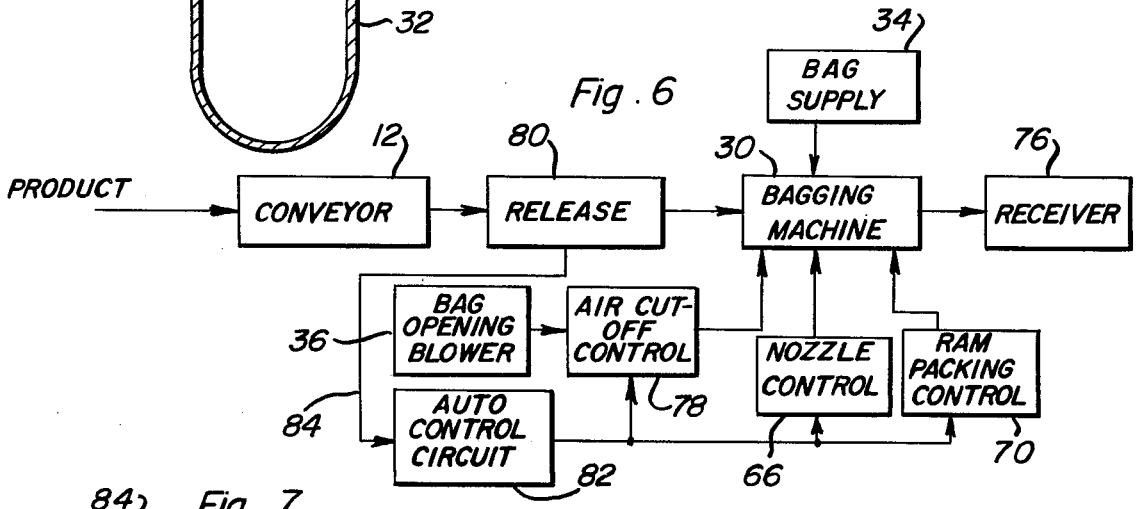
FIG. 6 is a schematic block diagram illustrating the control system associated with the present invention.

FIG. 6 diagrammatically illustrates the control system of the present invention depicting movement of a product in the form of poultry 16 by the conveyor 12 to the weighing station at which it is automatically released by a release mechanism 80 so that the product may drop into the bagging machine 30. The packaged bird is then dropped onto the receiver 76. Bags are supplied from a bag supply or bag rack 34 associated with the bagging machine which is also operationally controlled by the air cut-off control 78 as aforementioned, by the nozzle control actuator 66 and the ram packing control actuator 70 as aforementioned. The actuator controls are supplied with fluid under pressure for operation thereof through an automatic control circuit generally referred by reference numeral 82. An automatic packaging cycle is initiated through the control circuit upon receipt of a release signal from sensor 20 aforementioned fed to the control circuit by signal line 84 as shown in FIG. 6.

Figure 7:
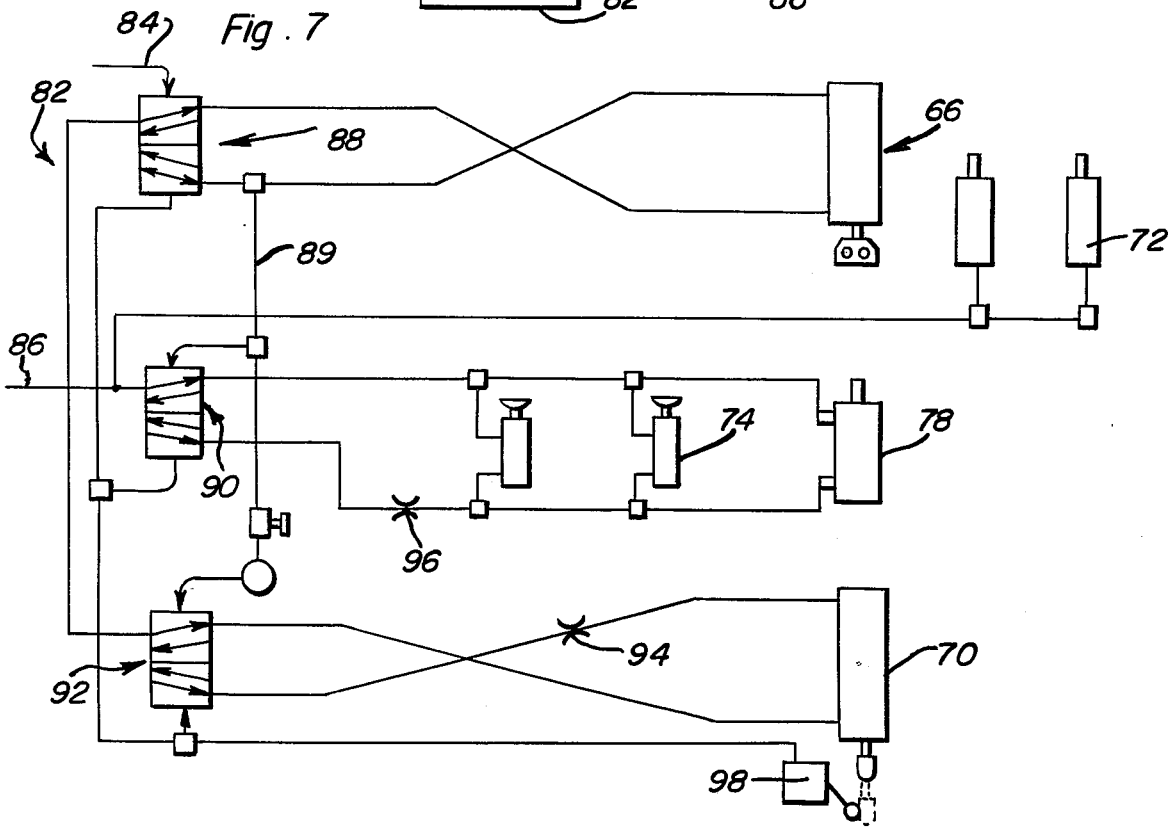
FIG. 7 is a simplified fluid circuit diagram corresponding to the control system illustrated in FIG. 6.

A simplified automatic control circuit 82 is shown in FIG. 7. The fluid operating medium utilized for the various controls aforementioned may be in the form of pressurized air from a suitable source through line 86 connected to a signal operated control valve 88. The control valve 88 may therefore be operated in response to a signal received from the release sensor 20 through line 84 establishing a fluid connection to the nozzle control 66. In response to operation of nozzle control 66, line 89 applies an operating signal to a control valve 90 to operate the blower cut-off control 78 and the bag clamp devices 74. Similarly, a signal operated control valve 92 is actuated to operate the ram packing control 70. As a result of such fluid connections in response to the release signal, the nozzle device is immediately projected into the open bag in advance of the descending bird. By means of any suitable delay device such as flow restrictors 94 and 96, delayed operation of the ram, blower cut off and bag clamps occurs to insure proper sequential operation resulting in the complete packing of the bird within the bag as hereinbefore described. When the ram completes its operational stroke, a limit sensor such as limit switch 98 may be closed in order to apply a valve reversing signal to the control valves 88, 90 and 92 causing reversal of the controls 66, 74, 78 and 70. All of such controls are simultaneously retracted immediately to complete an operational cycle as the limit switch 98 opens restoring the system to its initial condition.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a moving conveyor from which a single irregular-shaped, compressible object is dropped at a packaging station for guided gravitational descent along an entry passage extending into a single inflated bag made of stretchable material, movable nozzle means projected into the bag in response to release of the object from the conveyor for establishing said entry passage into the bag, and ram means engageable with the object only following partial entry thereof through said entry passage for packing the object into the bag.

2. The combination of claim 1 including blower means for inflation of the bag prior to drop of the object at the packaging station and means for interrupting said inflation of the bag by the blower means during establishment of said entry passage.

3. The combination of claim 1 including means for expanding the nozzle means during projection thereof into the bag to cause dimensional enlargement of the bag, and actuating means for effecting advancement of the nozzle means and the ram means in sequence followed by simultaneous retraction of the nozzle means and the ram means.

4. The combination of claim 1 wherein said object is a bird suspended by both legs from the conveyor.

5. The combination of claim 1 wherein said nozzle means includes a pair of confronting guide members engageable with the object during entry thereof into the bag, and linkage means connected to the guide members for positioning thereof to dimensionally vary said entry passage and compress the object laterally during said partial entry into the bag.

6. The combination of claim 5 including actuator means connected to the linkage means for displacing said guide members laterally while projecting the guide members into the bag in advance of the object.

7. In combination with a moving conveyor from which an irregular-shaped compressible object is dropped at a packaging station for guided descent into a flexible container having an opened end portion, nozzle means engageable with the object for lateral compaction thereof during said descent into the container, actuator means connected to the nozzle means for projection thereof into said opened end portion of the container in advance of the object and ram means engageable with the object only following partial entry thereof into the container for displacing the object through the nozzle means fully into the container.

8. The combination of claim 7 including means for clamping the bag to the nozzle means during entry of the object into the bag.

* * * * *